US006375487B1

(12) United States Patent
Tennessen

(10) Patent No.: US 6,375,487 B1
(45) Date of Patent: Apr. 23, 2002

(54) REMOVABLE CONNECTOR CABLE HAVING BEND AND STRAIN RELIEF WITH INTEGRAL SEAL

(75) Inventor: John Tennessen, Richfield, WI (US)

(73) Assignee: GE Medical Systems Information Technologies, Inc., Waukesha, WI (US)

( * ) Notice: Subject to any disclaimer, the term of this patent is extended or adjusted under 35 U.S.C. 154(b) by 0 days.

(21) Appl. No.: 09/559,621

(22) Filed: Apr. 27, 2000

(51) Int. Cl.[7] ..... H01R 13/62; H01R 13/64

(52) U.S. Cl. ..... 439/373; 439/923

(58) Field of Search ..... 439/373, 923, 439/357, 304, 367, 371, 360, 278, 281

(56) References Cited

U.S. PATENT DOCUMENTS

| | | | | |
|---|---|---|---|---|
| 4,632,121 A | * | 12/1986 | Johnson et al. | 128/639 |
| 4,828,509 A | * | 5/1989 | Vogel | 439/278 |
| 5,120,268 A | * | 6/1992 | Gerrans | 439/736 |
| 5,195,902 A | * | 3/1993 | Bengal | 439/188 |
| 5,378,882 A | * | 1/1995 | Gong et al. | 235/462.45 |
| 5,898,789 A | * | 4/1999 | Nichols et al. | 381/361 |
| 5,911,588 A | * | 6/1999 | Kern | 439/278 |

FOREIGN PATENT DOCUMENTS

JP 58-34372 U * 3/1983

* cited by examiner

*Primary Examiner*—Brian Sircus
*Assistant Examiner*—Brian S. Webb
(74) *Attorney, Agent, or Firm*—Michael Best & Friedrich LLP

(57) ABSTRACT

A connector cable assembly having an end adapted to be connected to a device. The connector cable assembly includes a connector at the end of the connector cable, a wire electrically connected to the connector, an insulating cover at least partially surrounding the wire, an overmolding at least partially surrounding a portion of the insulating cover, a seal portion adjacent the overmolding, and a clip positionable over at least a portion of the overmolding. The clip includes an engaging member for securing the clip and the connector to the device. Preferably, the overmolding is made from a thermoplastic material that at least partially surrounds the connector. It is also preferred that the seal portion is integral with the overmolding. The invention also provides a method of connecting a connector cable to a device having a housing defining an opening and having therein a socket. The method comprises inserting a connector through the opening and into the socket, sealing the opening with a portion of the connector cable, sliding a clip over the connector cable, and releasably engaging the clip with the housing. Preferably, the steps of inserting the connector and sealing the opening occur substantially simultaneously.

22 Claims, 3 Drawing Sheets

REMOVABLE CONNECTOR CABLE HAVING BEND AND STRAIN RELIEF WITH INTEGRAL SEAL

BACKGROUND OF THE INVENTION

The present invention relates to electronic or battery operated devices, and more particularly to connector cables for electronic or battery operated devices.

Electronic or battery operated devices often include cables or wires (hereinafter connector cables) that supply power or data input to the device. Likewise, connector cables are often used to output power or data from the device. Strong and reliable connections between the device and the connector cables are important to the successful operation of the device. The connections must be substantially unaffected by the bending of the connector cables near the connections. Furthermore, the connections should not be broken simply by pulling on the connector cable. It is also desirable to seal the device and connections to prevent entry of any liquid or moisture that could damage the device or disrupt the working of the device.

Strong and reliable connections are extremely critical in the medical device industry where data acquisition devices are used to measure and monitor vital patient information, such as heart rate, respiratory rate, brain activity and the like. Care must be taken to ensure that patients, visitors, and medical personnel cannot accidentally break the connection by pulling or bending the connector cables. Likewise, the devices and their connections should be impervious to liquids that may be present in the clinical environment.

One common method of providing a cable connection that addresses all of the above-mentioned problems includes creating a permanent connection inside the housing of the device and then mechanically capturing the cable in the housing of the device so that the bending or pulling of the cable experienced outside of the device does not translate to the connection inside the housing. Various methods and designs can be used to effectuate such mechanical capture. To allow for servicing of the connector cable and connection, resealable gaskets can be used in conjunction with mechanical capturing to form a water-tight seal between the housing portions and the connector cable, thereby prohibiting liquids from entering the housing. If a resealable gasket is not used, the device must be discarded if the connector cable is damaged.

Instead of capturing the cable in the housing of the device, another possibility is to simply make the connection inside the housing and then overmold the entire assembly so that the device and connector cable become integral and non-separable. Ideally, pulling or bending the overmolded connector cable will only translate force into the overmolding of the device and not to the connection. Even though the overmolding creates a substantially water-tight seal, resealable gaskets must still be used between the housing portions and the connector cable to permit servicing. Should the connector cable or connection need repair or replacement, the overmolding must be removed and the housing opened. After the connection is repaired, the gasket is resealed and the assembly is overmolded. Again, if no resealable gasket is used, the device must be discarded if the connector cable is damaged.

Another option is to provide a sealed connector or socket as an entry point to the device. Instead of having the connector cables pass through the housing of the device, the connector cable can simply connect to a connector socket located on or in the housing. Since access to the inside of the housing is not needed, this type of connection configuration eliminates the need for a resealable gasket, and the housings can be ultrasonically welded together around the socket. However, this type of connection configuration must provide sufficient resistance to pullout forces to avoid accidental disengagement of the connector cable. This typically means using more expensive connectors, which adds to the cost of the device. Additionally, some form of seal is still required around the socket to prevent liquid from entering the device through or adjacent the socket. Connections of this type are subject to rigid patient safety requirements, such as those set forth by UL and IEC.

SUMMARY OF THE INVENTION

The different types of connections discussed above suffer from various problems. For the first two assemblies discussed (those with the connections inside the housing of the device), damage to the connector cable requires servicing or replacement of the entire device. To repair or replace a damaged connector cable, the device must be opened by a qualified service technician so that the technician can access the connection. Assuming the device is not ultrasonically welded together and can be opened, the housing portions must be carefully separated so as not to damage the resealable gasket. After the repair is complete, the housing must be carefully re-assembled to ensure that the gasket properly seals the device. If the gasket is damaged during repair, it must be replaced or the device must be discarded.

In the case of a unit having an integrally overmolded connector cable and device, the overmolding must first be removed before access to the connection can be achieved. This is also a job for a qualified service technician. After the repair is completed and the device is carefully re-assembled as described above, the unit must again be overmolded prior to returning to use.

For units having a socket directly on or in the housing, the problem becomes finding a connector that can adequately withstand the pullout forces. While these connectors are available, they are more expensive than common connectors. Furthermore, the design must still incorporate a seal between the socket and the device. This also adds to the cost of the device. Additionally, these units must be designed to meet the patient safety regulations discussed above.

The present invention solves the above-identified problems with prior art connection methods and provides a strong and reliable connection for an electronic or battery operated device. Cost is kept to a minimum as the connector cable utilizes a relatively inexpensive standard connector that plugs into a socket disposed just inside the ultrasonically welded housing. The connector end of the connector cable is overmolded with a soft thermoplastic that acts to provide bend and strain relief to the cable. The overmolding also incorporates an integral seal that prevents moisture from entering the device at the point of connection. A plastic locking clip snaps into place over the connection and seal to prevent the connector cable from pulling out of the device. The invention provides a low cost, easy to service, and safe alternative to the prior art connection methods.

More specifically, the present invention provides a connector cable assembly having an end adapted to be connected to a device. The connector cable assembly comprises a connector at the end of the connector cable, a wire electrically connected to the connector, an insulating cover at least partially surrounding the wire, an overmolding at least partially surrounding a portion of the insulating cover, a seal portion adjacent the overmolding, and a clip positionable over at least a portion of the overmolding. The clip includes an engaging member for securing the clip and the connector to the device. Preferably, the overmolding is made from a thermoplastic material that at least partially surrounds the connector. It is also preferred that the seal portion is integral with the overmolding.

The present invention also provides a method of connecting a connector cable to a device having a housing defining an opening and having therein a socket. The method comprises inserting a connector through the opening and into the socket, sealing the opening with a portion of the connector cable, sliding a clip over the connector cable, and releasably engaging the clip with the housing. Preferably, the steps of inserting the connector and sealing the opening occur substantially simultaneously.

DETAILED DESCRIPTION OF THE PREFERRED EMBODIMENT

Figure 1:
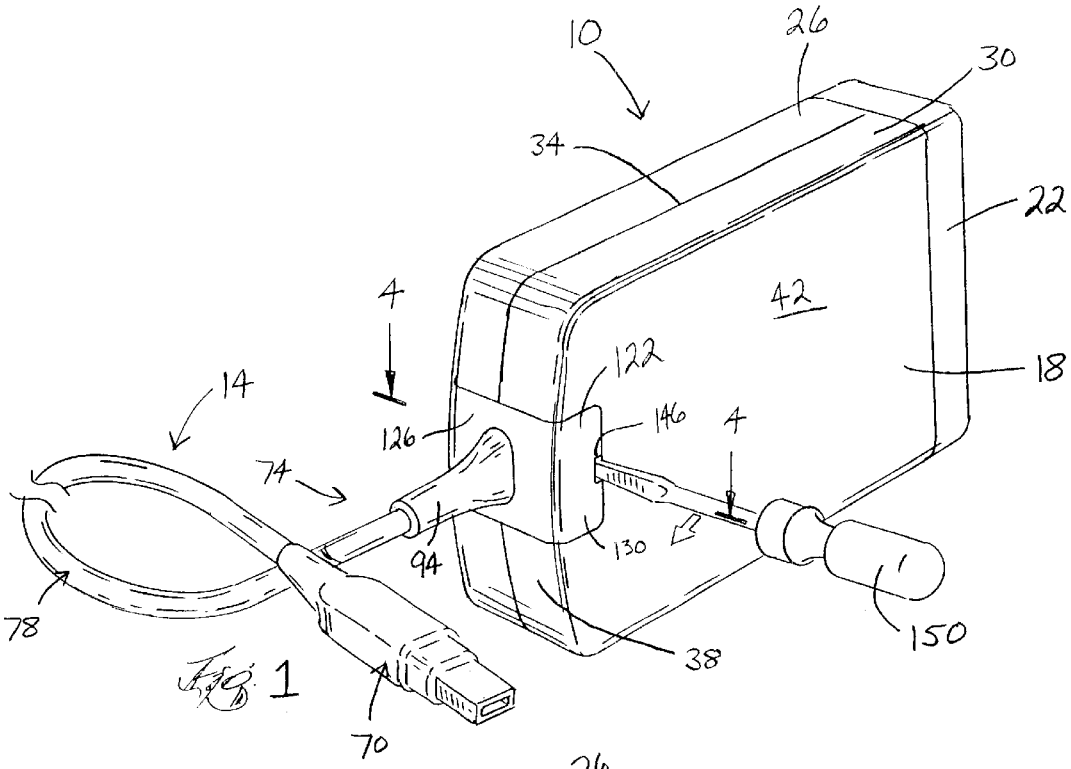
FIG. 1 is a perspective view of a device having a connector cable assembly embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

FIG. 1 illustrates a device 10 having a connector cable assembly 14 embodying the invention. The device 10 is an electronic or battery operated device, preferably for use in the medical field. It should be noted, however, that the invention can be practiced with any type of device that utilizes connector cables. The device 10 shown in FIG. 1 is a data acquisition unit used for monitoring the vital signs (eg., heart rate and respiratory rate) of a patient. The device 10 includes a circuit board (not shown) at least partially enclosed by a two-piece housing 18 and an end cap 22. The housing 18 is preferably made of plastic and includes a first housing portion 26 and a second housing portion 30 that are joined together along a seam 34. Preferably, the housing portions 18 and 26 are joined using an ultrasonic welding technique, but any other suitable method of permanently or releasably joining the housing portions together is acceptable. The end cap 22 is also preferably ultrasonically welded to the joined housing 18, but any other suitable method of connection is acceptable.

Figure 2:
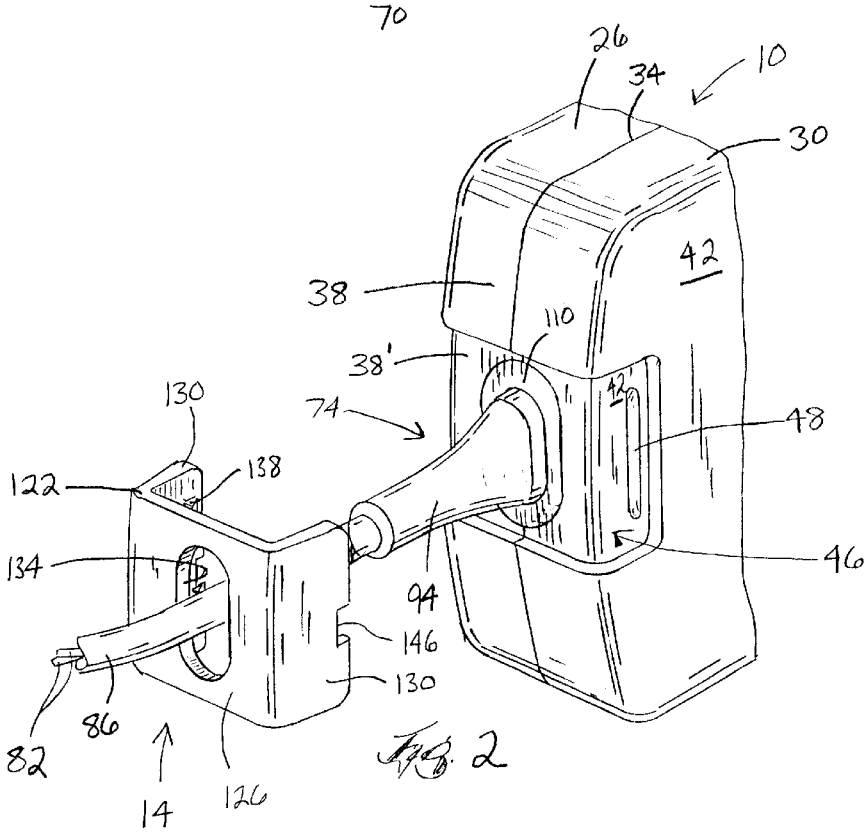
FIG. 2 is a perspective view of the device and connector cable assembly of FIG. 1 shown with the locking clip removed.
Figure 3:
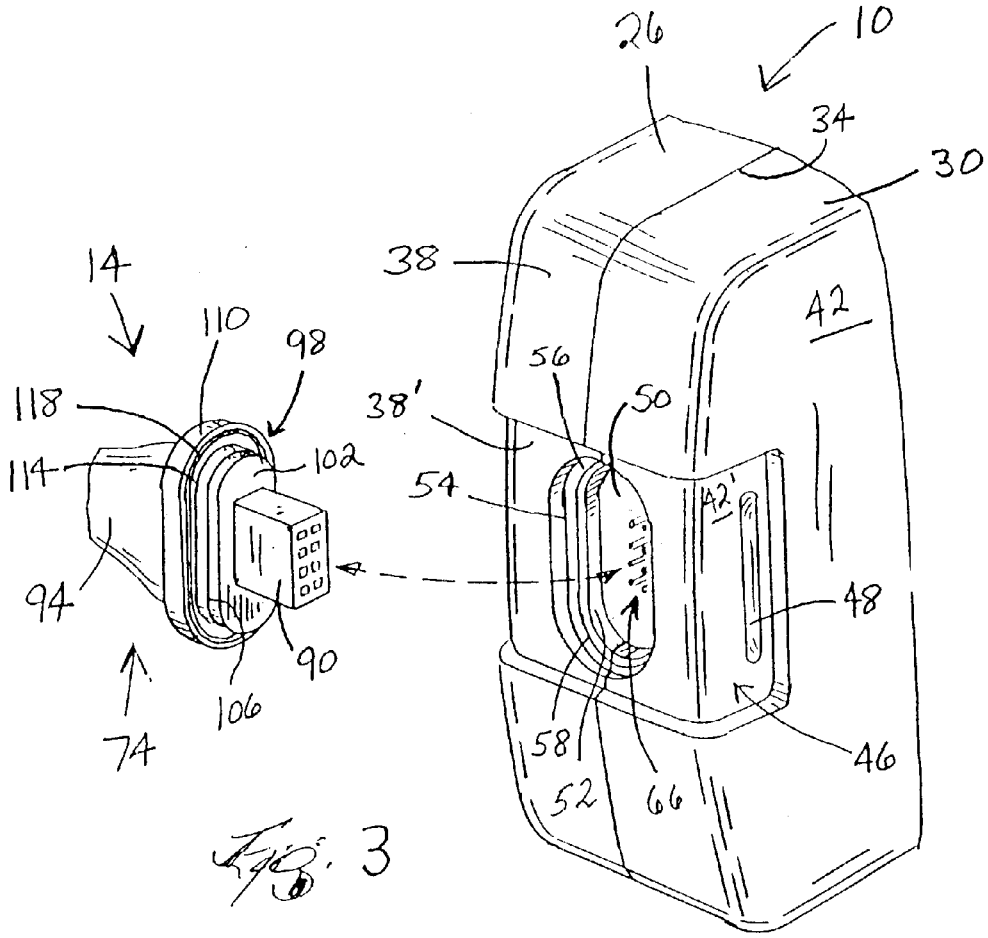
FIG. 3 is an end view of the connector cable when disconnected from the device.
Figure 4:
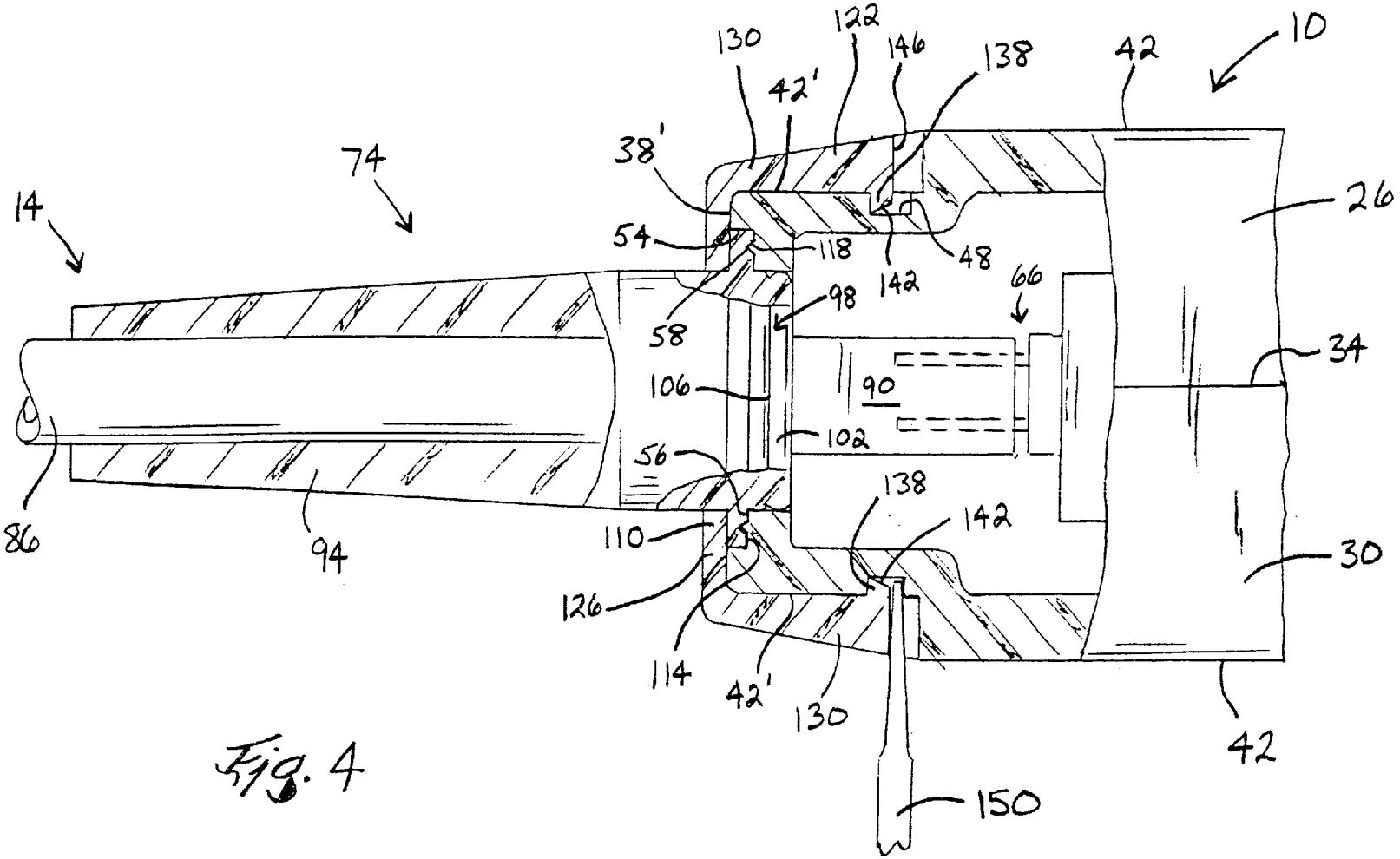
FIG. 4 is an enlarged section view taken along line 4—4 in FIG. 1.

Together, the housing portions 26 and 30 define a sidewall 38 and opposing faces 42. As best shown in FIGS. 2 and 3, each housing portion 26 and 30 defines one half of a clip receiving portion 46 that is recessed with respect to adjacent portions of the sidewall 38 and the opposing faces 42 to form a recessed sidewall portion 38' and opposing recessed face portions 42'. The recessed face portions 42' include respective elongated recesses 48. The recessed sidewall portion 38' has (see FIG. 3) an opening 50 defined by continuous edge portion 52. As seen in FIGS. 3 and 4, the continuous edge portion 52 includes a seal receiving recess 54 adjacent the opening 50. The recess 54 has a connecting face 56. The connecting face 56 has thereon an annular protrusion 58. While the opening 50 and seal receiving recess 54 are illustrated as being substantially oval or elliptical in shape, it should be noted that the opening 50 and seal receiving recess 54 can alternatively be circular, rectangular, triangular, etc, and need not both be the same shape.

The opening 50 provides access to an electrical connector or socket 66 that is mounted on the circuit board. In the illustrated embodiment, the socket 66 is the male portion of a standard eight-pin connector commonly used for data acquisition and electrical connection. It is important to note that the socket 66 is not limited to the illustrated embodiment, but can also include connectors of different types (such as those used only for supplying power to the device), connectors with fewer or more pins, or the female portion of any standard multi-pin connectors.

As shown in FIG. 1, the connector cable assembly 14 includes a monitor connection end 70 and a device connection end 74 electrically connected by an intermediate portion 78. The monitor connection end 70 is adapted to connect to a monitor and/or a power source (not shown) remote from the device 10. Signals and power are transferred through the connector cable assembly 14. The connector cable assembly 14 also includes (see FIG. 2) a wire or wires 82 surrounded by an insulating cover 86. The insulating cover is preferably thermoplastic, and more preferably urethane. At the device connection end 74, the wires 82 are electrically connected to a connector 90 (see FIGS. 3 and 4), which is adapted to connect with the socket 66. In the illustrated embodiment, the connector 90 is the female portion of a standard eight-pin connector commonly used for data acquisition. As stated above with respect to the socket 66, the invention is not limited to the connector 90 shown in the figures, but can be any type of connector adapted to connect to the socket 66.

The device connection end 74 also includes an overmolding 94 that partially surrounds the wires 82 and preferably surrounds at least a portion of the insulating cover 86 and at least a portion of the connector 90. The overmolding 94 is preferably made from molded-on thermoplastic, and more preferably injection molded-on urethane, to provide bend and strain relief to the device connection end 74. In other words, the overmolding 94 provides an area adjacent the connector 90 that is substantially more rigid than the intermediate portion 78 and substantially prevents the loss of connection between the connector 90 and the socket 66 due to stresses and strains exerted on the connector cable assembly 14.

The connector cable assembly 14 also includes (see FIGS. 3 and 4) a seal portion 98 adjacent to, and preferably integral with, the overmolding 94. The seal portion 98 includes a radial inner portion 102 having a shape that corresponds with, and is insertable into the opening 50 as the connection is made between the connector 90 and the socket 66. The radial inner portion 102 includes (see FIG. 4) a circumferential groove 106 that aids in sealing the opening 50 upon insertion of the radial inner portion 102. The seal portion 98 also includes a seal flange 110 extending radially outward from the radial inner portion 102. The seal flange 110 also has a shape that corresponds with, and is at least partially insertable into, the seal receiving recess 54 as the connection is made between the connector 90 and the socket 66. The seal flange 110 includes a connecting face 114 having therein an annular groove 118 adapted to receive the annular protrusion 58 on the connecting face 56 of the seal receiving recess 54. The engagement of the annular groove 118 and the annular protrusion 58 aids in sealing the device to prevent moisture or fluid from entering the opening 50.

The connector cable assembly 14 further includes a clip 122 that is preferably slidably retained between the monitor connection end 70 and the device connection end 74. The clip 122 is substantially C-shaped in cross-section, and includes a central portion 126 and two arm portions 130. The central portion 126 includes (see FIG. 2) an aperture 134 that is configured to prevent the clip 122 from sliding off the connection ends 70 and 74. Additionally, the aperture 134 is configured such that the clip 122 can slide over the overmolding 94 until the inner surface of the central portion 126 contacts the seal flange 110.

The arm portions 130 are substantially identical and each includes (see FIG. 4) a respective engaging member 138. Each engaging member 138 is preferably an elongated protrusion that has a ramped surface 142, the purpose of which will be described below. The arm portions 130 also include respective tool receiving slots 146.

The clip 122 releasably secures the device connection end 74 to the device 10 after the connection between the connector 90 and the socket 66 is made. To this effect, the clip 122 is slidable from a first position (shown in FIG. 2), wherein the clip 122 is distant from the overmolding 94 and seal portion 98, to a second position (shown in FIGS. 1 and 4) wherein the clip 122 is adjacent the overmolding 94 and seal portion 98. When the clip 122 is in the first position, the connection can be made by inserting the connector 90 into the opening 50 and connecting the connector 90 to the socket 66. Once the connection is made, the clip 122 is slidable into the second position, wherein the clip 122 is releasably received in the clip receiving portion 46 to secure the clip 122 and the device connection end 74 to the device 10.

More specifically, as the clip 122 is moved from the first position to the second position, the aperture 134 helps center and align the clip 122 for insertion into the clip receiving portion 46. The arm portions 130 are aligned to engage the opposing recessed face portions 42'. As the respective ramped surfaces 142 contact their respective opposing recessed face portions 42', the arm portions 130 flex or deflect outwardly and slide into the clip receiving portion 46 until the engaging members 138 snap into the corresponding elongated recesses 48. At this point, the inner surface of the central portion 126 abuts the seal flange 110 and substantially prevents the seal portion 98 and connector 90 from being disconnected and pulled out of the opening 50. Additionally, the central portion 126 substantially covers the seal flange 110 to further prevent any moisture or liquid from entering the device 10. The clip 122 can be slid into the second position manually without the use of any tools, thereby allowing for fast and easy assembly.

When snapped into place, the clip 122 substantially fills the clip receiving portion 46 such that the housing 18 and clip 122 together define a substantially smooth and continuous profile along the sidewall 38 and the opposing face portions 42. Preferably, the clip is injection molded from the same plastic as the housing 18 to give the assembled device 10 a uniform appearance. To remove the clip, a tool 150 is inserted into at least one tool receiving slot 146. As seen in FIGS. 1 and 4, the tool is preferably a flat head screwdriver that can be used to pry one or both of the engaging members 138 out of the elongated recesses 48, thereby freeing the clip 122 from the housing 18. It is important to note that the clip 122 should not be manually removable from clip receiving portion 46 without the aid of a tool 150. This prevents the accidental removal or disconnection of the connector 90 and ensures proper operation of the device 10. Once free, the clip 122 can be slid to the first position, allowing the device connection end 74 to be disconnected from the device 10 for repair, replacement, storage, transport, etc.

It should be noted that the invention is not limited only to the configuration described above. For example, the clip 122 could be removable from the remainder of the connector cable assembly 14 and could be slidable over the monitor connection end 70 for removal or replacement. Furthermore, the configuration of the engaging members 138 and elongated recesses 48 could be varied from the illustrated embodiment without deviating from the invention. Likewise, the invention could be practiced with the engaging members 138 located on the opposing recessed face portions 142' and the elongated recesses 48 located on the arm portions 130 of the clip 122. Finally, it is important to note that the housing 18 and clip 122 are not limited to the specific shapes, sizes or materials described or illustrated.

Various features of the invention are set forth in the following claims.

What is claimed is:

1. A device assembly comprising:

a device having a connector receiving socket;

a housing surrounding the device and having a recessed clip receiving portion, an opening in the clip receiving portion providing access to the connector receiving socket, and a seal flange recess substantially circumscribing the opening; and a connector cable connected to the device, the connector cable including a connector received in the connector receiving socket;

an overnolding at least partially surrounding a portion of the connector;

a seal portion integrally formed with the overnolding, the seal portion including a seal flange extending radially outward from the overrnolding and received in the seal flange recess to substantially seal the opening; and a clip positioned over at least a portion of the overnolding and received in the clip receiving portion so that the clip engages the seal flange and secures the seal flange in the seal flange recess.

2. The device assembly of claim 1, wherein the seal flange includes a connecting face having therein an annular groove, and wherein the seal flange recess includes a connecting face having thereon an annular protrusion that is received in the annular groove of the seal flange to facilitate sealing when the seal flange is in the seal flange recess.

3. The device assembly of claim 1, wherein the clip includes an aperture sized to permit the clip to slide over the connector cable and the overmolding until a portion of the clip engages the seal flange.

4. The device assembly of claim 1, wherein the seal portion further includes a radial inner portion adjacent the seal flange, the radial inner portion having a sealing surface received in the opening to further seal the opening.

5. The device assembly of claim 4, wherein the sealing surface of the radial inner portion is substantially normal to the seal flange.

6. The device assembly of claim 4, wherein the sealing surface of the radial inner portion includes a circumferential groove that facilitates sealing the opening.

7. The device of claim 1, wherein the clip includes an engaging member that engages a recess formed in the clip receiving portion.

8. The device of claim 1, wherein the clip includes a slot for receiving a tool that disengages the clip from the housing.

9. The device of claim 1, wherein the clip is made from the same material as the housing.

10. The device of claim 9, wherein the clip and the housing are made.

11. The device of claim 1, wherein the connector is a pin connector.

12. The device of claim 1, wherein the clip and the housing define a substantially smooth and continuous profile when the clip is received in the clip receiving portion.

13. A device assembly comprising:

a device having a connector receiving socket;

a housing surrounding the device and having a recessed clip receiving portion, an opening in the clip receiving portion providing access to the connector receiving socket, and a seal flange recess substantially circumscribing the opening; and a connector cable connected to the device, the connector cable including a pin connector received in the connector receiving socket;

an overmolding at least partially surrounding a portion of the connector;

a seal portion integrally formed with the overmolding, the seal portion including a seal flange extending radially outward from the overmolding and received in the seal flange recess to substantially seal the opening; and a clip positioned over at least a portion of the overmolding and received in the clip receiving portion so that the clip and the housing define a substantially smooth and continuous profile and the clip engages the seal flange and secures the seal flange in the seal flange recess, the clip having an engaging member that engages a recess formed in the clip receiving portion.

14. The device assembly of claim 13, wherein the seal flange includes a connecting face having therein an annular groove, and wherein the seal flange recess includes a connecting face having thereon an annular protrusion that is received in the annular groove of the seal flange to facilitate sealing when the seal flange is in the seal flange recess.

15. The device assembly of claim 13, wherein the clip includes an aperture sized to permit the clip to slide over the connector cable and the overmolding until a portion of the clip engages the seal flange.

16. The device assembly of claim 13, wherein the seal portion further includes a radial inner portion adjacent the seal flange, the radial inner portion having a sealing surface received in the opening to further seal the opening.

17. The device assembly of claim 16, wherein the sealing surface of the radial inner portion is substantially normal to the seal flange.

18. The device assembly of claim 16, wherein the sealing surface of the radial inner portion includes a circumferential groove that facilitates sealing the opening.

19. The device of claim 13, wherein the clip further includes a slot for receiving a tool that disengages the clip from the device.

20. The device of claim 13, wherein the clip is made from the same material as the housing.

21. The device of claim 20, wherein the clip and the housing are made of plastic.

22. The device of claim 13, wherein the device is a data acquisition device used for monitoring vital signs.

* * * * *

UNITED STATES PATENT AND TRADEMARK OFFICE

CERTIFICATE OF CORRECTION

PATENT NO. : 6,375,487 B1
DATED : April 23, 2002
INVENTOR(S) : John Tennessen

It is certified that error appears in the above-identified patent and that said Letters Patent is hereby corrected as shown below:

Column 7,
Line 10, insert the words "of plastic" after the word "made."

Signed and Sealed this

Fifth Day of November, 2002

*Attest:*

*Attesting Officer*

JAMES E. ROGAN
*Director of the United States Patent and Trademark Office*